US010370982B2

(12) United States Patent
Roberts

(10) Patent No.: US 10,370,982 B2
(45) Date of Patent: Aug. 6, 2019

(54) DOUBLE SHELF SQUEALER TIP WITH IMPINGEMENT COOLING OF SERPENTINE COOLED TURBINE BLADES

(71) Applicant: DOOSAN HEAVY INDUSTRIES CONSTRUCTION CO., LTD., Gyeongsangnam-do (KR)

(72) Inventor: Steven Roberts, Port St. Lucie, FL (US)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 203 days.

(21) Appl. No.: 15/424,755

(22) Filed: Feb. 3, 2017

(65) Prior Publication Data

US 2018/0223675 A1 Aug. 9, 2018

(51) Int. Cl.
*F01D 5/18* (2006.01)
*F01D 5/20* (2006.01)

(52) U.S. Cl.
CPC ..... *F01D 5/187* (2013.01); *F01D 5/20* (2013.01); *F05D 2240/307* (2013.01); *F05D 2260/201* (2013.01)

(58) Field of Classification Search
CPC ... F01D 5/187; F01D 5/20; F01D 5/14; F01D 5/18; F01D 5/147; F05D 2240/307; F05D 2260/201; F05D 2220/32
USPC ..... 416/97 R
See application file for complete search history.

(56) References Cited

U.S. PATENT DOCUMENTS 4,753,575 A * 6/1988 Levengood ..... F01D 5/187 415/115
5,902,093 A * 5/1999 Liotta ..... F01D 5/20 415/115
6,168,381 B1 * 1/2001 Reddy ..... F01D 5/186 415/116
9,546,554 B2 * 1/2017 Crites ..... F01D 5/187

FOREIGN PATENT DOCUMENTS

WO 2016/076834 A1 5/2016
WO WO 2016076834 A1 * 5/2016 ..... F01D 5/187

OTHER PUBLICATIONS

A Korean Office Action dated Apr. 4, 2019 in connection with Korean Patent Application No. 10-2018-0012939 which corresponds to the above-referenced U.S. application.

* cited by examiner

*Primary Examiner* — Jason D Shanske
*Assistant Examiner* — Brian Christopher Delrue
(74) *Attorney, Agent, or Firm* — Invenstone Patent, LLC

(57) ABSTRACT

A turbine blade comprises a leading edge, a trailing edge, a squealer tip floor, and one or more walls arranged to form a cooling circuit within the turbine blade, the one or more walls forming an impingement shelf having one or more impingement holes through which coolant is expelled to cool the turbine blade.

18 Claims, 5 Drawing Sheets

Related Art

Related Art

DOUBLE SHELF SQUEALER TIP WITH IMPINGEMENT COOLING OF SERPENTINE COOLED TURBINE BLADES

BACKGROUND

Combustors, such as those used in gas turbines, for example, mix compressed air with fuel and expel high temperature, high pressure combustion gas downstream. The energy stored in the gas is then converted to work as the high temperature, high pressure combustion gas expands in a turbine, for example, thereby turning a shaft to drive attached devices, such as an electric generator to generate electricity. The shaft has a plurality of turbine blades shaped such that the expanding hot gas creates a pressure imbalance as it travels from the leading edge to the trailing edge, thereby turning the turbine blades to rotate the shaft.

FIG. 1 shows a gas turbine 20. Air to be supplied to the combustor 10 is received through air intake section 30 of the gas turbine 20 and is compressed in compression section 40. The compressed air is then supplied to headend 50 through air path 60. The air is mixed with fuel and combusted at the tip of nozzles 70 and the resulting high temperature, high pressure gas is supplied downstream. In the exemplary embodiment shown in FIG. 1, the resulting gas is supplied to turbine section 80 where the energy of the gas is converted to work by turning shaft 90 connected to turbine blades 95.

One effective method of cooling the turbine blade exposed to very high gaspath temperatures is to generate serpentine cooling passages within the blade. The resulting internal cooling circuit channels coolant, normally extracted from the compressor bleed, through the airfoil of the blade and through various film cooling holes around the surface thereof. One type of airfoil extends from a root at a blade platform (not shown), which defines the radial inner flowpath for the combustion gases, to a radial outer cap or blade tip section, and includes opposite pressure and suction sides extending axially from leading to trailing edges of the airfoil. The cooling circuit extends inside the airfoil between the pressure and suction sides and is bounded at its top by the blade tip section. As coolant flows through the cooling passages, heat is extracted from the blade, thereby cooling the part.

FIG. 2A is a cross sectional view of a serpentine cooled turbine blade 95 with a conventional squealer tip design. FIG. 2B is a cross sectional view along lines A-A of FIG. 2A. As shown, squealer tip 100 has squealer tip floor 110. As the coolant flows through the cooling circuit defined by serpentine walls 130, the heat accumulated on the turbine blade 95 are transferred to the coolant, and the heated air is expelled through openings on the trailing edge 140.

However, the trailing edge tip region of a serpentine cooled turbine blade is subjected to very high heat loads as, due to gas path migration effects, hot gas originating from the leading edge mid-span surrounds the region on the pressure side of the blade. These high heat loads cause very high coating/metal temperatures that can lead to premature coating failure and substrate oxidation. Because thermal barrier coating, also known as TBC, is generally removed locally at the tip after the first rub, it is of limited benefit. Furthermore, adding film holes in this region is of limited cooling benefit due to the difficulty in configuring film holes such that they penetrate into the cooling cavities of the blade.

BRIEF SUMMARY

In one embodiment of the invention, a turbine blade comprises a leading edge, a trailing edge, a squealer tip floor, and one or more walls arranged to form a cooling circuit within the turbine blade, the one or more walls forming an impingement shelf having one or more impingement holes through which coolant is expelled to cool the turbine blade.

In another embodiment of the invention, an impingement shelf of a turbine blade comprises one or more walls arranged to form a serpentine cooling circuit within the turbine blade, and one or more impingement holes through which coolant is expelled to cool the turbine blade.

DETAILED DESCRIPTION

Various embodiments of a double shelf squealer tip with impingement cooling are described. It is to be understood, however, that the following explanation is merely exemplary in describing the devices and methods of the present disclosure. Accordingly, any number of reasonable and foreseeable modifications, changes, and/or substitutions are contemplated without departing from the spirit and scope of the present disclosure. For purposes of explanation and consistency, like reference numbers are directed to like components in the figures.

Figure 1:
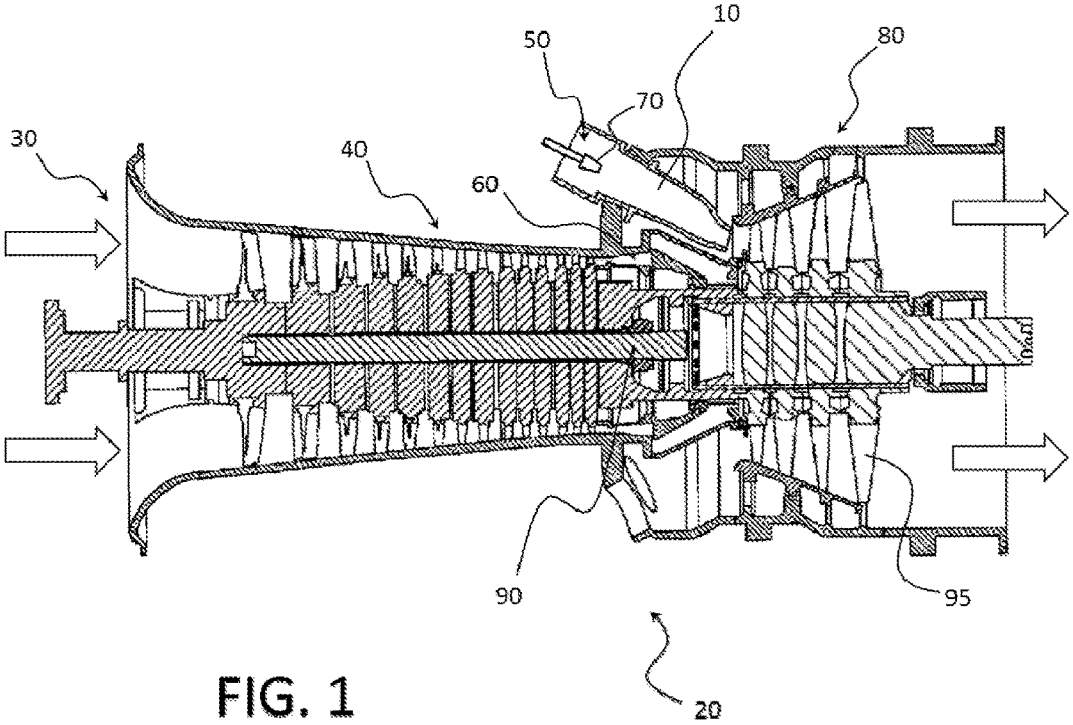
FIG. 1 shows a gas turbine, according to an example embodiment.
Figure 2A:
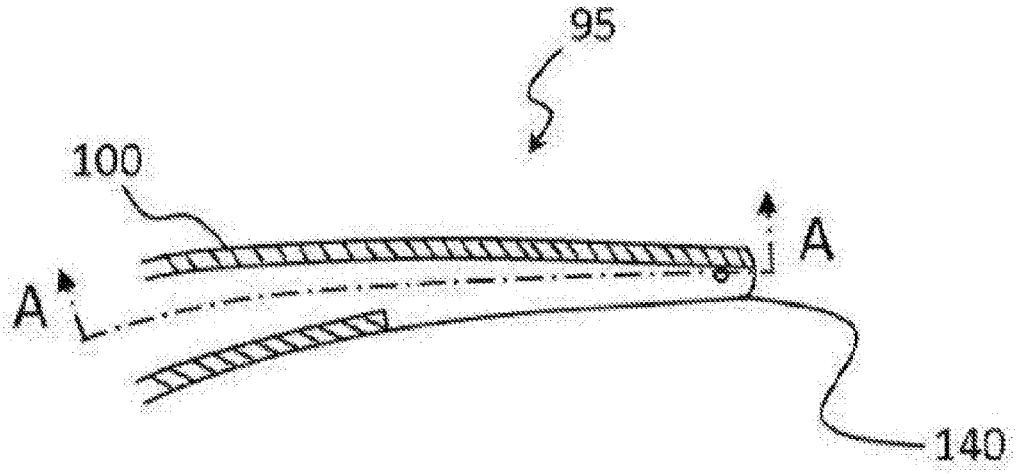
FIG. 2A is a cross sectional view of serpentine cooled turbine blade with a conventional squealer tip design.
Figure 2B:
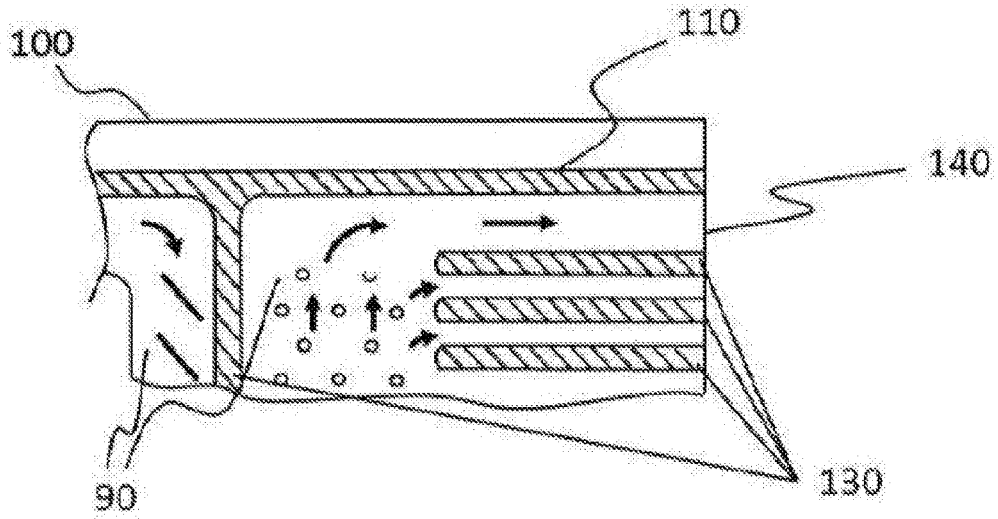
FIG. 2B is a cross sectional view along lines A-A of FIG. 2A.
Figure 3A:
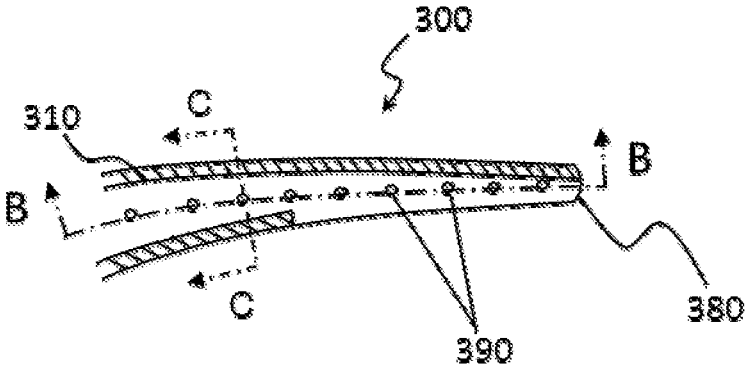
FIG. 3A is a cross sectional top-down view of a serpentine cooled turbine blade, according to an example embodiment.
Figure 3C:
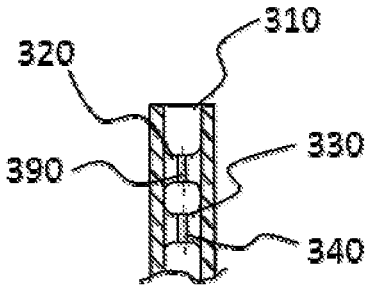
FIG. 3C is a cross sectional view along lines C-C of FIG. 3A.
Figure 3B:
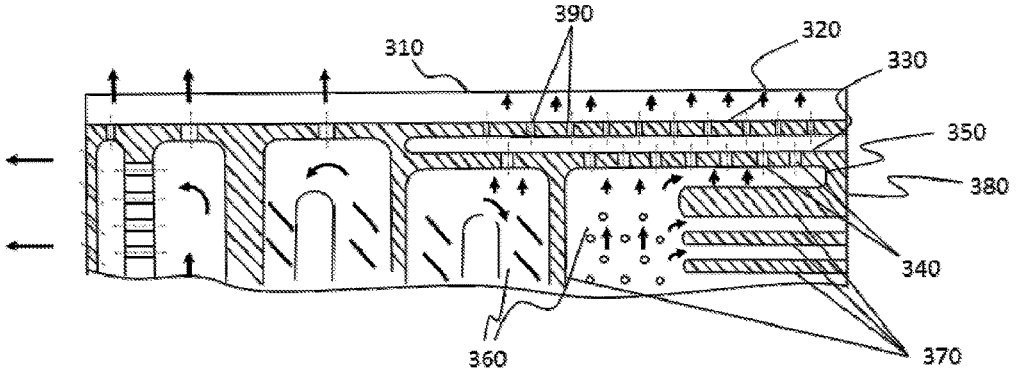
FIG. 3B is a cross sectional view along lines B-B of FIG. 3A.

FIG. 3A is a cross sectional top-down view of an exemplary embodiment of a serpentine cooled turbine blade 300. FIG. 3B is a cross sectional view along lines B-B of FIG. 3A. FIG. 3C is a cross sectional view along lines C-C of FIG. 3A. An exemplary serpentine cooled turbine blade 300 includes squealer tip 310 having squealer tip floor 320 and impingement shelf 330. The impingement shelf 330 includes a plurality of impingement holes 340 along the length of the impingement shelf 330 and an aft tip turnaround section 350. The coolant (e.g., cooled air) flowing through cooling circuit 360 defined by serpentine walls 370 are forced to exit through the impingement holes 340 by a trailing edge cavity formed by the aft tip turnaround section 350 onto the bottom surface of the squealer tip floor 320. In a further exemplary embodiment, squealer tip floor 320 includes a plurality of vent holes 390. Accordingly, improved cooling of this region will result from impingement heat transfer on the impingement target surface along with local convection effects on both the impingement holes 340 and the vent holes 390. Furthermore, the coating and substrate oxidation life in the trailing tip region of the serpentine cooled turbine blade 300 will be improved.

In an exemplary embodiment, the squealer tip floor 320 and the impingement shelf 330 may be arranged parallel to each other. However, the angle between the squealer tip floor 320 and the impingement shelf 330 may be varied without departing from the scope of the present invention.

In another exemplary embodiment, the aft tip turnaround section 350 may be formed by adding a cast-in material or any other type of obstruction to block the flow of the circulating through the trailing edge 380 and force the air through the impingement holes 340. However, the aft tip turnaround section 350 may be formed integrally with the impingement shelf without departing from the scope of the present invention.

In yet another exemplary embodiment, intermediate shelf or shelves with impingement holes may be arranged between the impingement shelf 330 and the squealer tip floor 320 without departing from the scope of the invention.

Some of the advantages of the exemplary embodiments include: improved design life and reliability of the turbine blades with reduced fallout rate during maintenance intervals, prevention of premature coating failure and expected substrate oxidation that eventually lead to catastrophic failure resulting in a forced outage of the unit, and increased profitability of service agreements due to improved life of hot gas path components.

It will also be appreciated that this disclosure is not limited to turbine blades in gas turbines. Other serpentine cooled blades in high heat environments may realize the advantages of the present disclosure. Further, the shapes, sizes, and thicknesses of the impingement holes and vent holes are not limited to those disclosed herein. Additionally, any combination of impingement and vent holes having different size, thickness, and shape may be combined without departing from the scope of the present invention. Still further, the impingement and vent holes may be arranged equidistant from each other, at different intervals, or with varying porosity (i.e., number of holes per area) without departing from the scope of the present invention.

The breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A turbine blade comprising:

a leading edge;

a trailing edge disposed opposite to the leading edge;

a squealer tip floor extending between the leading and trailing edges; and one or more walls arranged to form a cooling circuit within an airfoil of the turbine blade, the one or more walls forming an impingement shelf having a plurality of impingement holes through which coolant is expelled to cool the turbine blade, wherein the cooling circuit communicates with a trailing edge cavity formed by a turnaround section configured to guide the coolant to the plurality of impingement holes and to force the coolant through the impingement holes by blocking a flow of the coolant through the trailing edge, and wherein the plurality of impingement holes are arranged along a length of an upper side of the turnaround section.

2. The turbine blade of claim 1, wherein the squealer tip floor includes one or more vent holes through which the coolant expelled from the plurality of impingement holes are vented.

3. The turbine blade of claim 2, wherein each vent hole of the squealer tip floor and each impingement hole of the impingement shelf communicates with a median cavity interposed between the squealer tip floor and the impingement shelf, and wherein the median cavity does not communicate with the leading edge.

4. The turbine blade of claim 3, wherein the median cavity extends from the trailing edge by a length equal to a length of the impingement shelf.

5. The turbine blade of claim 4, wherein the impingement shelf forms an upper boundary of the cooling circuit.

6. The turbine blade of claim 1, wherein the turnaround section is formed at the trailing edge of the turbine blade.

7. The turbine blade of claim 1, wherein the impingement shelf and the squealer tip floor are parallel to each other.

8. The turbine blade of claim 1, wherein the one or more walls forming the cooling circuit include a plurality of walls extending into the cooling circuit from the trailing edge, the plurality of walls including one wall forming a bottom side of the trailing edge cavity disposed in opposition to a bottom surface of the impingement shelf.

9. An impingement shelf of a turbine blade including a leading edge and a trailing edge disposed opposite to the leading edge, the impingement shelf extending between the leading and trailing edges and comprising:

one or more walls arranged to form a serpentine cooling circuit within an airfoil of the turbine blade; and a plurality of impingement holes through which coolant is expelled to cool the turbine blade, the plurality of impingement holes communicating with the serpentine cooling circuit, wherein the serpentine cooling circuit communicates with a trailing edge cavity formed by a turnaround section configured to guide the coolant to the plurality of impingement holes and to force the coolant through the impingement holes by blocking a flow of the coolant through the trailing edge, and wherein the plurality of impingement holes are arranged along a length of an upper side of the turnaround section.

10. The impingement shelf of claim 9, wherein the turnaround section is formed at the trailing edge of the turbine blade.

11. The impingement shelf of claim 9, wherein the plurality of impingement holes are configured to direct the coolant expelled from the plurality of impingement holes to one or more vent holes formed on a squealer tip floor of the turbine blade.

12. The impingement shelf of claim 11, wherein the impingement shelf and the squealer tip floor are parallel to each other.

13. The impingement shelf of claim 11, wherein the plurality of impingement holes are configured to direct the coolant expelled from the plurality of impingement holes to one or more vent holes formed on the squealer tip floor.

14. The impingement shelf of claim 13, wherein each vent hole of the squealer tip floor and each impingement hole of the impingement shelf communicates with a median cavity interposed between the squealer tip floor and the impingement shelf, and wherein the median cavity does not communicate with the leading edge.

15. The impingement shelf of claim 14, wherein the median cavity extends from the trailing edge by a length equal to a length of the impingement shelf.

16. The impingement shelf of claim 15, wherein the impingement shelf forms an upper boundary of the serpentine cooling circuit.

17. The impingement shelf of claim 9, wherein the one or more walls forming the serpentine cooling circuit include a plurality of walls extending into the cooling circuit from the trailing edge, the plurality of walls including one wall forming a bottom side of the trailing edge cavity disposed in opposition to a bottom surface of the impingement shelf.

18. A turbine blade comprising:

an airfoil having a leading edge and a trailing edge and including a cooling circuit formed by one or more serpentine walls;

a squealer tip floor extending between the leading and trailing edges; and an impingement shelf facing a portion of the squealer tip floor and having a plurality of impingement holes through which coolant is expelled to cool the turbine blade, wherein the cooling circuit communicates with a trailing edge cavity formed by a turnaround section configured to guide the coolant to the plurality of impingement holes and to force the coolant through the impingement holes by blocking a flow of the coolant through the trailing edge, and wherein the plurality of impingement holes are arranged along a length of an upper side of the turnaround section.

* * * * *